US007217939B2

(12) United States Patent
Johansson et al.

(10) Patent No.: US 7,217,939 B2
(45) Date of Patent: May 15, 2007

(54) CAPILLARY TUBING

(75) Inventors: Göran Johansson, Stockholm (SE); Hans Hertz, Stocksund (SE); Jaco De Groot, Stockholm (SE)

(73) Assignee: Jettec AB, Stocksund (SE)

( * ) Notice: Subject to any disclaimer, the term of this patent is extended or adjusted under 35 U.S.C. 154(b) by 0 days.

(21) Appl. No.: 10/522,026

(22) PCT Filed: Jul. 18, 2003

(86) PCT No.: PCT/SE03/01225

§ 371 (c)(1),
(2), (4) Date: Apr. 26, 2005

(87) PCT Pub. No.: WO2004/010745

PCT Pub. Date: Jan. 29, 2004

(65) Prior Publication Data

US 2005/0175149 A1 Aug. 11, 2005

(30) Foreign Application Priority Data

Jul. 23, 2002 (SE) ..... 0202320

(51) Int. Cl.
*H05H 1/00* (2006.01)
*G21G 4/00* (2006.01)
*H01J 35/00* (2006.01)

(52) U.S. Cl. ..... 250/504 R; 250/492.2; 378/119; 378/120; 378/329; 378/111.21; 239/136; 239/337; 239/373

(58) Field of Classification Search ..... None
See application file for complete search history.

(56) References Cited

U.S. PATENT DOCUMENTS 4,723,262 A 2/1988 Noda et al.
6,002,744 A * 12/1999 Hertz et al. ..... 378/119
6,760,406 B2 * 7/2004 Hertz et al. ..... 378/119
6,933,515 B2 * 8/2005 Hartlove et al. ..... 250/504 R

FOREIGN PATENT DOCUMENTS

WO WO 99/51356 10/1999

OTHER PUBLICATIONS

O. Hemberg et al., "*Target Analysis of Laser-Plasma Droplet-Target System*", Proc. SPIE vol. 4144 (2000) pp. 38 to 42.

* cited by examiner

*Primary Examiner*—Jack Berman
*Assistant Examiner*—Zia R. Hashmi
(74) *Attorney, Agent, or Firm*—Buchanan Ingersoll & Rooney PC

(57) ABSTRACT

A method and an arrangement for generating x-ray or EUV radiation are disclosed. Target material is supplied from a container for target material to a jet-forming orifice in an interaction chamber by means of a flexible capillary tubing of considerable length, wherein the orifice is an integral part of the capillary tubing. A jet formed by urging target material through the orifice is made to interact with a beam of energy, thus producing a radiating plasma emitting the desired electromagnetic radiation. The use of a flexible capillary tubing for supplying target material from a source of target material to an orifice, which is integrated with the tubing, within an interaction chamber, in order to form therein a jet of target material for interaction with an energy beam to generate x-ray or EUV radiation, is also disclosed.

23 Claims, 4 Drawing Sheets

CAPILLARY TUBING

TECHNICAL FIELD OF THE INVENTION

The present invention relates to a method and an arrangement for generating x-ray or EUV radiation from laser produced plasmas. The invention also relates to use of capillary tubing in such method and arrangement.

TECHNICAL BACKGROUND

X-ray and EUV sources based on emission from a laser produced plasma in a target jet are becoming increasingly important since they provide a high-density regenerative target in combination with negligible debris operation. To this date, commercially available glass nozzles have primarily been used to produce the target jet, resulting in limited flexibility in the choice of jet dimensions, speed and jet material.

X-ray and EUV sources of the above-mentioned kind feature high flux and brightness, allow long-term operation without interruption and emit narrow bandwidth radiation appropriate for zone-plate optics. Furthermore spectrally tailored emission for a specific application can be produced by selecting a target material with proper elemental contents.

Methods for generating x-ray or EUV radiation via laser produced plasma emission are known in the prior art. For example, U.S. Pat. No. 6,002,744 discloses a method wherein a target is generated in a chamber and at least one pulsed laser beam is focused on the target in the chamber to produce the radiating plasma.

Until now, these target jets have been produced using commercially available tapered glass nozzles. Unfortunately these nozzles have a fixed diameter and the range of usable target materials is limited since several interesting target materials have shown to dissolve some parts of the nozzle.

Other problems are associated with the prior art technology regarding the way the target material is supplied to the jet-forming nozzle.

For cryogenic applications, wherein a material that is gaseous at room temperature and atmospheric pressure cooled to liquid state, the cooling of the target material must be done within the chamber in which the plasma is to be produced.

Furthermore, when an organic material such as e.g. alcohols are employed, there is a tendency of pollution of the passageways in the supply system for the target material. The reason is that many carbon based materials may dissolve parts of the equipment or seals used, such that the target material contains fragments or substances that may then clog the jet-forming nozzle. This problem is accentuated by the numerous joints in the supply system for the target material. Many inorganic materials, which may have aggressive properties, can lead to similar problems.

In addition, rather large volumes of target material must be handled and pressurized. Some target materials used are expensive, and for this reason alone the volume that has to be handled should be kept at a minimum. Furthermore, the target material must be kept at a desired pressure and temperature, which of course is rendered more difficult if dealing with large volumes.

Consequently, there is a need for improved methods and arrangements for generating x-ray or EUV radiation via plasma emission.

SUMMARY OF THE INVENTION

It is an object of the present invention to solve the above-mentioned problems by providing an improved method and arrangement for generating x-ray or EUV radiation.

According to the invention, this object is achieved by a method or an arrangement according to the appended claims, wherein target material is fed to a jet-forming orifice via a capillary tubing of considerable length having an integrated orifice.

In one aspect, the present invention provides a method of generating x-ray or EUV radiation.

In another aspect, the present invention provides an arrangement for generating x-ray or EUV radiation.

In yet another aspect, the present invention provides the use of a flexible capillary tubing having an integral orifice at an output end thereof, for supplying target material from a source of target material to an interaction chamber, in order to form therein a jet of target material for interaction with an energy beam to generate x-ray or EUV radiation. Preferably, the flexible tubing used has a length no less than 10 cm. In some embodiments, it is preferred that the tubing used is made of fused silica.

According to the invention, a means for transporting target material (liquid or gas) from a target material container to an interaction chamber, and a jet-forming orifice are integrated into a single structural component. Preferably, the orifice is comprised of a taper of an end portion of the flexible capillary tubing (the means for transporting target material).

By employing a flexible capillary tubing of considerable length (typically longer than about 10 cm) for supplying target material to a jet-forming orifice inside an interaction chamber, wherein said orifice is an integral part of the capillary tubing, one or more of the following advantages are obtained:

- Transition from atmospheric pressure to decreased pressure, or vacuum, inside the interaction chamber is drastically facilitated, since only a capillary tubing of small diameter needs to pass into the interaction chamber.
- The container for target material can be conveniently positioned remote from the interaction chamber.
- The number of joints in the supply system for target material is reduced, thereby reducing problems related to pollution/clogging of the supply system.
- Only a very small volume of target material is present within the interaction chamber, actually eliminating the need for target material reservoirs inside the interaction chamber, thus reducing the required volume of the interaction chamber and facilitating, for example, maintaining a low pressure or vacuum in the interaction chamber.
- Gaseous target material can easily be condensed by cooling during its propagation through the capillary tubing in order to exit through the orifice in liquid state, while at the same time cooling of the target material in general is simplified, effectively allowing online cooling ("on-the-fly").
- Well known techniques and materials from, for example, the field of capillary electrophoresis can be utilized in a method and arrangement for generation of x-ray or EUV radiation.
- Orifices of a desired diameter can easily be formed at the end of the capillary tubing and integrated therewith by means of standard micropipette-pulling machines.

Standard components used in the prior art for connecting nozzles or other parts are eliminated. In particular, components that deteriorate and tend to become brittle or ever shatter in cryogenic application (i.e. at low temperatures), such as o-rings and adhesives, are eliminated.

Furthermore, the pressure range is improved and the fabrication of the integrated nozzle has sufficient control of nozzle size and geometry. Thus, it is possible to operate at higher target velocities and at larger diameters than in the prior art, making it possible to extend the applicability of the liquid-jet mode also to high-surface tension liquids. In effect, higher target velocities lead to the drop formation point for the target being moved further away from the nozzle.

Hence, a flexible tubing for feeding target material between a reservoir and an interaction chamber is provided, wherein a jet-forming orifice is integrated with the capillary tubing. In addition to the advantages mentioned above, the flexible tubing with an orifice that is integral therewith leads to shorter manufacturing times for the tubing and orifice compared to prior art nozzles that are glued to a transport tube, and gives lower variable costs by allowing reuse of some parts of the system (e.g. filters).

In one preferred embodiment of the method according to the invention, target material is urged into an input end of the capillary tubing in gaseous state, and condensed within said tubing in order to exit the same at an output end in liquid state into the interaction chamber.

In preferred embodiments of the invention, the capillary tubing is made from a material that is inert to the target material, preferably fused silica.

BRIEF DESCRIPTION OF THE DRAWINGS

In the following detailed description of preferred embodiments of the invention, reference is made to the accompanying drawings, on which.

DETAILED DESCRIPTION OF PREFERRED EMBODIMENTS

Fabrication

By way of introduction, the preferred procedure for preparing a capillary orifice will be described in some detail below.

Figure 1:
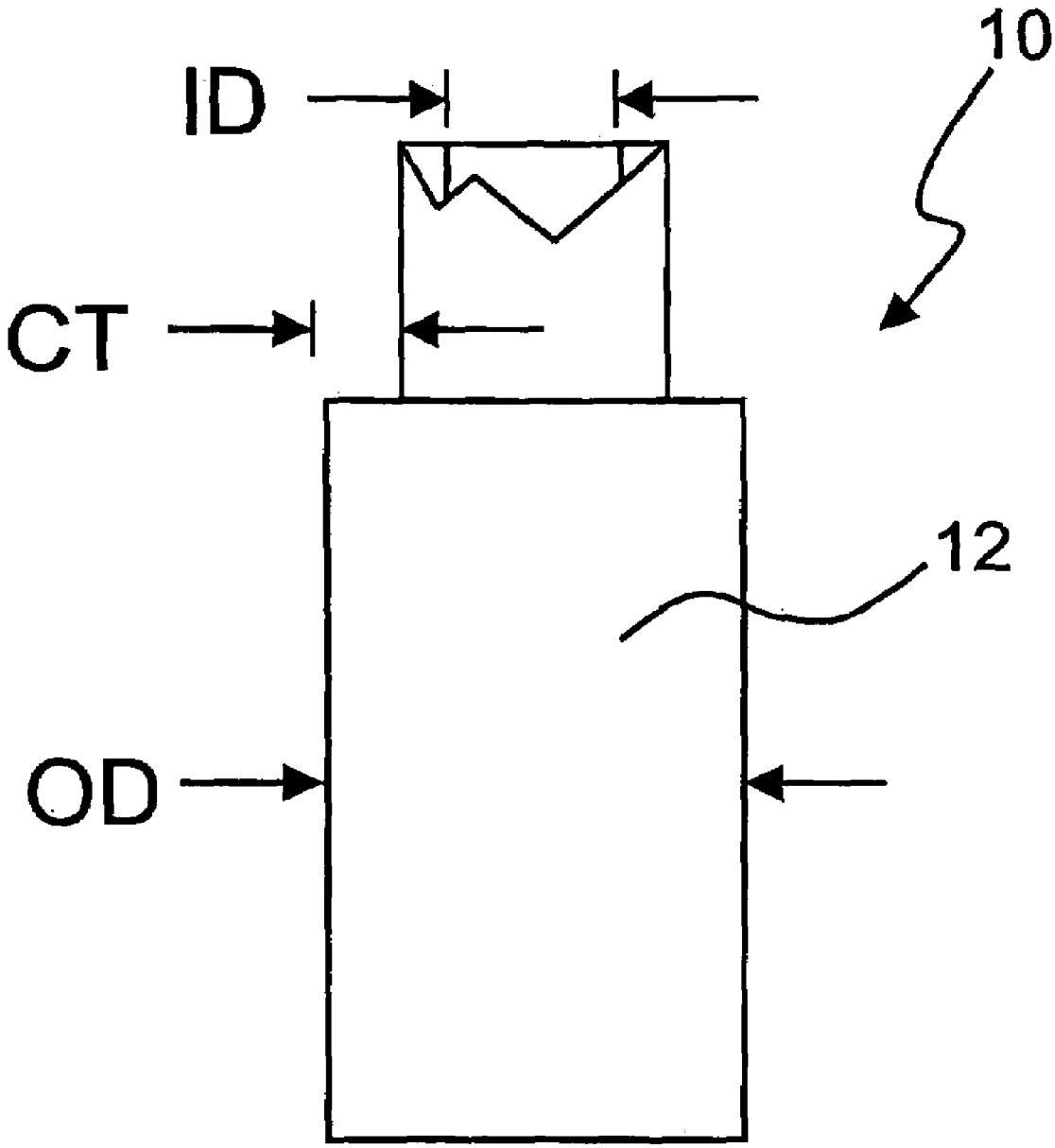
FIG. 1 shows an end portion of a flexible capillary tubing for use in connection with the present invention.

The starting-point of the orifice fabrication is a synthetic fused silica capillary tubing 10, an end portion of which is schematically shown in FIG. 1, which has a length of approximately 50 cm and which is coated with a polyimide coating 12. The inner diameter ID of the tubing is about 100 μm and the outer diameter OD of the tubing is about 375 μm. The coating thickness CT is typically about 20 μm. This type of capillary tubing is normally used in electrophoresic measurements and has been found to be sufficiently clean for use in connection with target forming in x-ray or EUV sources. One example of suitable fused silica capillary tubing is the tubing with product descriptor TSP100375, which is commercially available from Polymicro Technologies, Phoenix, Ariz., US.

The capillary tubing is connected to a metal inline filter (0.5 μm) by means of standard HPLC ("High Performance Liquid Chromatography") and CE ("Capillary Electrophoresis") components (not shown). These components are preferably made of polyetheretherketon (PEEK), which is a material that is compatible with most common solvents, except for some strong acids like concentrated nitric and sulphuric acid. However, components made of stainless steel can also be used.

Figure 2:
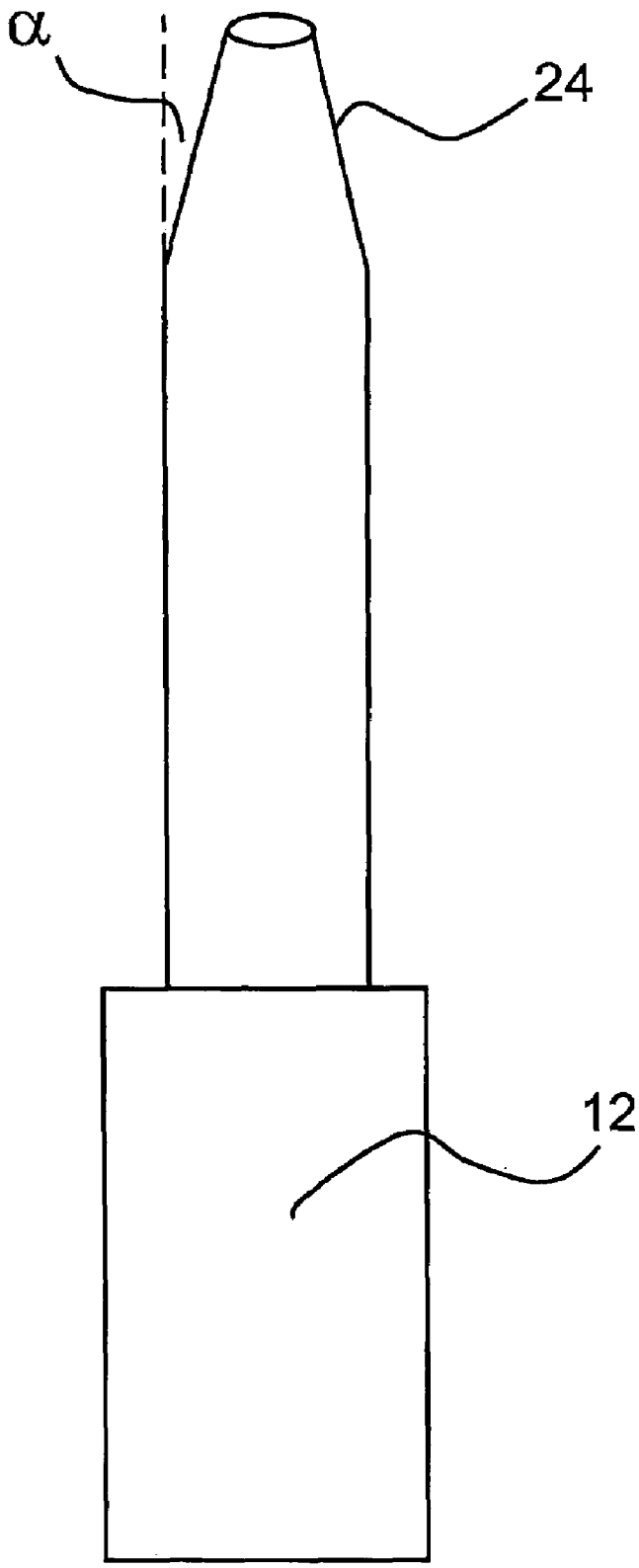
FIG. 2 shows an end portion of a flexible capillary, on which an orifice in the form of a taper has been formed.

General reference will now be made to FIG. 2, in which an end portion of a capillary tubing 20 with an integrated orifice in the form of a taper 24 is schematically shown.

Approximately two centimeters of the polyimide coating 12 is removed by placing the capillary tubing inside a glowing wire furnace for several seconds. Subsequently, the capillary tubing is mounted in a laser-based micropipette-pulling machine. The region without the polyimide coating is mounted in the laser focus and the capillary is pulled to a taper.

The geometry of the taper 24 can be varied by adjusting the pulling parameters. The taper angle $\alpha$ is not critical for the forming of a stable liquid jet as long as it lies between 15 and 90 degrees. A taper angle of 20 degrees is chosen in this case, since a slow taper allows better control of the orifice diameter during the polishing process.

After the pulling process is completed, the taper 24 is polished down from the end to achieve the required inner diameter of the orifice end opening. The taper 24 is polished with diamond lapping film (with a grain size of 0.5 μm) rotating at 200 rpm. The polishing paper is wetted by flushing the orifice at a pressure of 50 bars. During the polishing process, the orifice is demounted several times to measure the jet diameter under a microscope until the required jet diameter is achieved within ±2 μm.

Experiments

Figure 3:
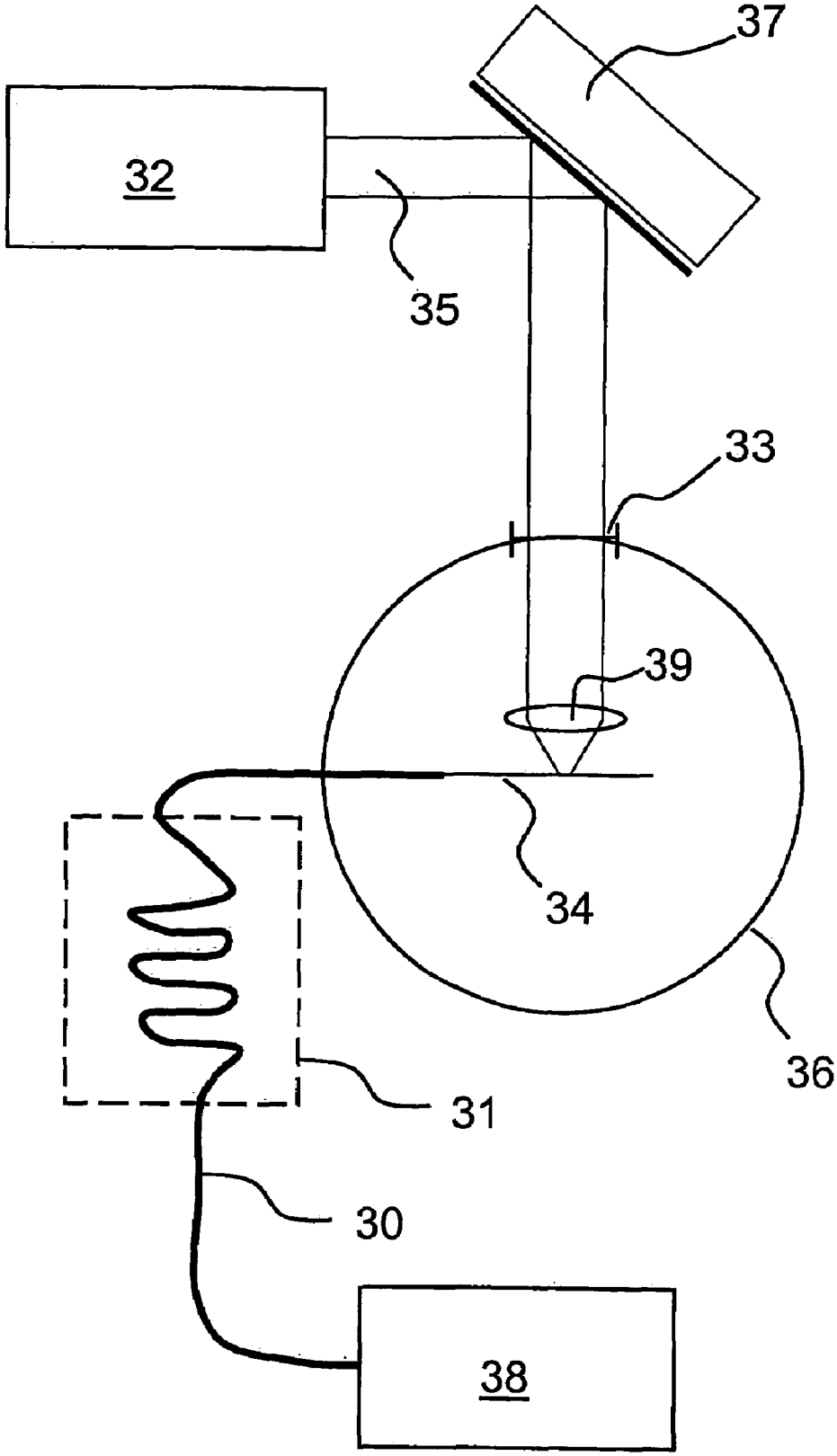
FIG. 3 shows a setup for generating x-ray or EUV radiation, wherein target material is fed to the interaction chamber, and the target jet is formed in accordance with the present invention.

The stability of the jet is determined by measuring the x-ray flux from a laser-produced plasma. In the present experiment, laser plasma is generated when 65 mJ, $\lambda$=532 nm, 3 ns pulses from a 100 Hz Nd:YAG laser are focused onto a target consisting of a liquid ethanol jet with a diameter of 22 μm. The liquid jet is formed by urging ethanol through the orifice at a pressure of 100 bars. At this pressure, the jet speed is approximately 80 m/s. The background pressure is $10^{-3}$ mbar. The setup is schematically shown in FIG. 3. A similar basic setup is also used in an actual source for x-ray or EUV radiation in which the present invention is employed.

A laser 32 emits a laser beam 35 which is to interact with the target jet 34 inside the interaction chamber 36. A target material container 38 provides target material that is fed through the flexible capillary tubing 30 into the interaction chamber 36. Typically, the laser beam 35 enters the interaction chamber via a window 33 and is directed thereto by one or more mirrors 37. Inside the interaction chamber, the laser beam 35 is focused by a lens 39 onto the target jet 34.

For many target materials, cooling has to be applied in order for the target material to condense to liquid form. Such cooling is accomplished by leading the flexible capillary tubing through an optional cooling device 31 (indicated in the figure by broken lines). In the shown example, the cooling device 31 is located outside the interaction chamber 36. However, it is to be understood that the cooling device could also be located within the interaction chamber. In either case, cooling of target material is drastically simplified in the present invention by providing the possibility of online cooling, i.e. cooling of target material during its propagation through the capillary tubing 30.

Figure 4:
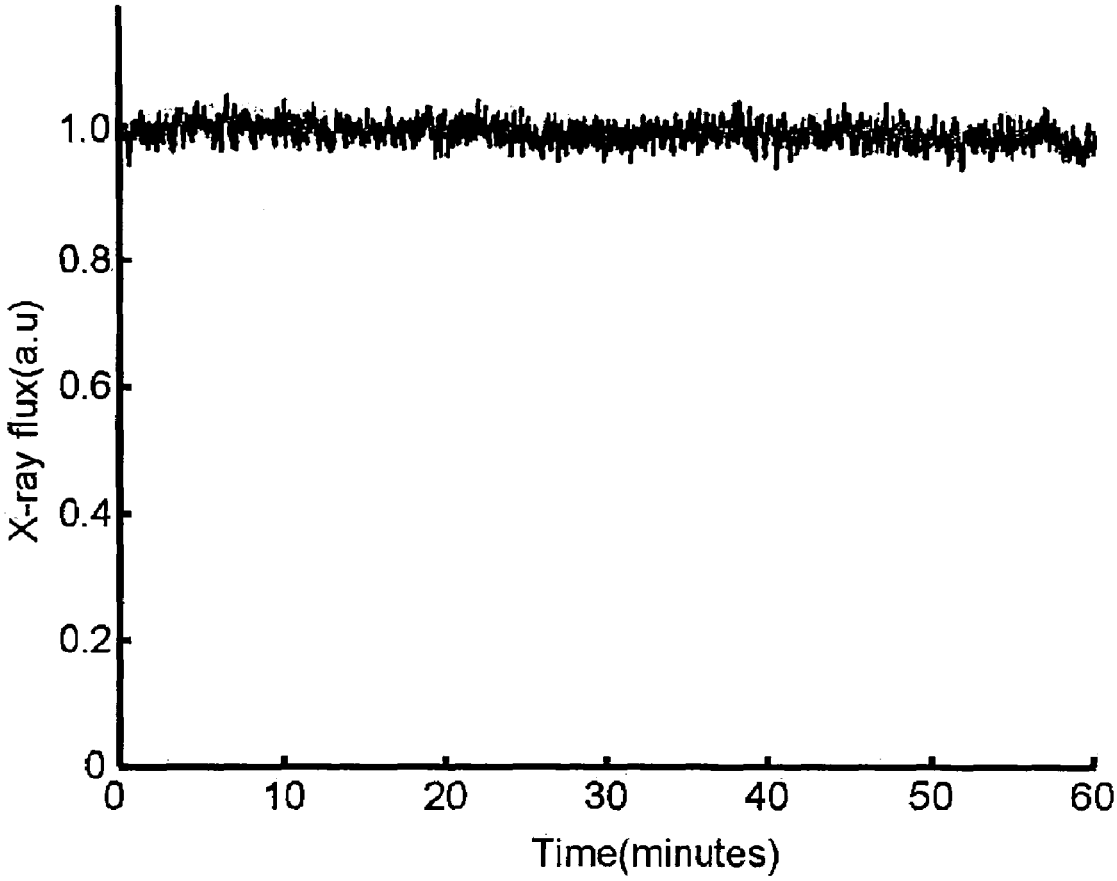
FIG. 4 is a graph showing the x-ray flux over time in a test setup according to the invention.

During one hour approximately every second the x-ray flux average over 100 pulses is measured. The x-ray flux is measured with a filtered x-ray diode. The result is plotted in FIG. 4.

EXAMPLES

In the following, some preferred implementations utilizing a capillary tubing according to the present invention will be described. Again, general reference is made to FIG. 3 of the accompanying drawings.

A first example of an arrangement in which a capillary tubing 30 is employed for supplying target material from a reservoir 38 of target material to a jet-forming orifice (not shown) in the interaction chamber 36 is based upon the advantage of online cooling. According to the present-invention, the container (or reservoir) 38 for target material is located outside the interaction chamber 36. In this particular example, the target material is nitrogen, which is to form a jet of target material in liquid state upon exit from the jet-forming orifice. The capillary tubing 30 is connected at one end to the target material reservoir 38. At the other end of the capillary, an orifice is formed in the manner described above. The capillary 30 has a length of about 50 cm and passes through, between the reservoir 38 and the interaction chamber 36, a vessel 31 containing liquid nitrogen. Other types of cooling means surrounding the capillary tubing are also possible. The cooling section 31 is schematically shown in the figure as a box indicated by broken lines. Gaseous nitrogen is urged into the capillary at the first end, and on its way through the capillary, the nitrogen is condensed by the cooling effect of the liquid nitrogen surrounding part of the capillary. Consequently, nitrogen is ejected through the orifice in liquid state, thus forming a liquid target jet inside the interaction chamber 36. Directing a laser beam 35 onto the target jet thus forms a plasma radiating the desired electromagnetic radiation.

A second example is based on the advantage of the possibility to position the target material container remote from the interaction chamber, and on the possible reduction in interaction chamber volume. In prior art apparatus for generating x-ray or EUV radiation from a plasma produced by exposing a target jet to an energy beam within an interaction chamber, the reservoir for the target material has been located inside a vacuum chamber. By using a flexible capillary tubing according to the present invention having an orifice that is integral therewith, the target material container can be freely positioned at a suitable place outside the interaction chamber. By virtue of the flexibility of the tubing, and its small dimensions, a passage for the target material into the interaction chamber can easily be achieved. Furthermore, the smaller dimension of the inventive device, compared to arrangements according to the prior art, facilitates online cooling of the target material. In this way, the interaction chamber can have a smaller volume than what has been possible in the prior art. The smaller volume of the interaction chamber makes both vacuum pumping and cooling (when applicable) much more convenient. Cooling of the target material can be performed both outside and inside the interaction chamber. For materials that have a condensation temperature close to room temperature, it can be preferred to have the cooling performed outside the interaction chamber, while for materials that have a condensation temperature far below room temperature the cooling is preferably performed within the interaction chamber.

In addition to liquid nitrogen, other target materials are also conceivable, such as Xe, Ar, as well as other substances that are or can be made liquid. For some applications, carbon compounds and solutions are desired, such as alcohols. Another preferred target material is ammonia.

In a further development of the present invention, a capillary having a plurality of holes is employed in order to form a plurality of parallel target jets in the interaction chamber. Alternatively, a number of capillaries with integrated orifices can be bunched together into a single entity, which terminates in the interaction chamber. For example, a multi-hole capillary similar to a so-called holey fiber can advantageously be used. In a multi-hole capillary, a single tubing comprises a plurality of longitudinal holes, each providing a target jet in the interaction chamber. When an end portion of the single tubing is pulled to a taper, each of the said holes is provided with an orifice integral with the tubing. The motive for using this kind of tubing is that more target material can be supplied to a confined region of the interaction chamber without substantially increasing the risk of turbulence occurring in the target jet. Turbulence is more likely to occur when using an orifice of larger diameter.

CONCLUSION

The combined orifice and transport means (tubing) obtained by the above fabrication method has distinct advantages compared to commercially available nozzles. Secondly, the orifice fabrication method gives sufficient control of the orifice size and geometry, which allows the jet diameter to be selected with an accuracy of 2 μm. Thirdly, this orifice design can be relatively easily adapted for cryogenic use by online cooling of the fused silica capillary. Finally, the orifice design allows a simple feed through into a vacuum system by combining HPLC and CE components with commercially available liquid feed through components.

It will be obvious to persons skilled in the art that other embodiments than those shown and described, as well as various modifications thereof, are possible within the scope of the invention as defined in the appended claims.

The invention claimed is:

1. A method of generating x-ray or EUV radiation, comprising the steps of:

(i) urging a target material through a flexible capillary tubing from an input end to an output end, said target material exiting the capillary tubing in liquid state into an interaction chamber, such that a target jet is formed in the interaction chamber; and (ii) directing at least one energy beam onto said target jet, the energy beam interacting with the target jet in the interaction chamber to generate said x-ray or EUV radiation;

wherein the target material exits the capillary tubing through an orifice at said output end, said orifice being an integral part of the capillary tubing, and wherein the target material is cooled during its propagation from the input end to the output end of the capillary tubing.

2. A method as claimed in claim 1, wherein the length of the capillary tubing between its input end and its output end is no less than 10 cm.

3. A method as claimed in claim 1, wherein target material is urged into the input end of the capillary tubing outside the interaction chamber, target material thereby being fed into the interaction chamber via said capillary tubing.

4. A method as claimed in claim 1, wherein the target material is in gaseous state at the input end of the capillary tubing, and wherein the target material is condensed during its propagation from the input end to the output end of the capillary tubing, to exit through said orifice in liquid state.

5. A method as claimed in claim 1, wherein target material is fed through a flexible capillary tubing having a plurality of holes, in order to form a plurality of parallel target jets in the interaction chamber.

6. An arrangement for generating x-ray or EUV radiation, comprising:

a source of target material;

an interaction chamber;

an energy source for generating an energy beam;

an orifice having an opening into the interaction chamber;

a flexible capillary tubing connecting the source of target material to the orifice;

means for urging target material from the source of target material, via said capillary tubing, out through said orifice in a liquid state to form a target jet in the interaction chamber;

means for directing the energy beam from the energy source onto the target jet to interact with the same, thus producing said x-ray or EUV radiation; and means for cooling the target material during its propagation from the input end to the output end of the capillary tubing, wherein the orifice is an integral part of the capillary tubing.

7. An arrangement as claimed in claim 6, wherein the length of the capillary tubing between its input end and its output end is no less than 10 cm.

8. An arrangement as claimed in claim 6, wherein the capillary tubing is made from fused silica.

9. An arrangement as claimed in claim 6, wherein the source of target material is arranged outside the interaction chamber, said capillary tubing forming a passageway for target material into the interaction chamber.

10. An arrangement as claimed in claim 6, wherein the background pressure inside the interaction chamber is about $10^{-6}$ Bar.

11. An arrangement as claimed in claim 6, wherein the orifice is comprised of a taper formed at the output end of the capillary tubing.

12. An arrangement as claimed in claim 6, comprising a flexible capillary tubing having a plurality of longitudinal holes arranged to form a plurality of parallel target jets in the interaction chamber when target material is fed through said tubing.

13. A method as claimed in claim 2, wherein target material is urged into the input end of the capillary tubing outside the interaction chamber, target material thereby being fed into the interaction chamber via said capillary tubing.

14. A method as claimed in claim 2, wherein the target material is in gaseous state at the input end of the capillary tubing, and wherein the target material is condensed during its propagation from the input end to the output end of the capillary tubing, to exit through said orifice in liquid state.

15. A method as claimed in claim 3, wherein the target material is in gaseous state at the input end of the capillary tubing, and wherein the target material is condensed during its propagation from the input end to the output end of the capillary tubing, to exit through said orifice in liquid state.

16. A method as claimed in claim 13, wherein the target material is in gaseous state at the input end of the capillary tubing, and wherein the target material is condensed during its propagation from the input end to the output end of the capillary tubing, to exit through said orifice in liquid state.

17. A method as claimed in claim 2, wherein target material is fed through a flexible capillary tubing having a plurality of holes, in order to form a plurality of parallel target jets in the interaction chamber.

18. A method as claimed in claim 3, wherein target material is fed through a flexible capillary tubing having a plurality of holes, in order to form a plurality of parallel target jets in the interaction chamber.

19. A method as claimed in claim 4, wherein target material is fed through a flexible capillary tubing having a plurality of holes, in order to form a plurality of parallel target jets in the interaction chamber.

20. An arrangement as claimed in claim 7, wherein the capillary tubing is made from fused silica.

21. An arrangement as claimed in claim 7, wherein the source of target material is arranged outside the interaction chamber, said capillary tubing forming a passageway for target material into the interaction chamber.

22. An arrangement as claimed in claim 8, wherein the source of target material is arranged outside the interaction chamber, said capillary tubing forming a passageway for target material into the interaction chamber.

23. An arrangement as claimed in claim 20, wherein the source of target material is arranged outside the interaction chamber, said capillary tubing forming a passageway for target material into the interaction chamber.

* * * * *